US010520272B1

(12) United States Patent
Carson et al.

(10) Patent No.: US 10,520,272 B1
(45) Date of Patent: Dec. 31, 2019

(54) CANNON RECOIL INHIBITOR AND IMPULSE NOISE ATTENUATOR

(71) Applicant: U.S. Government as Represented by the Secretary of the Army, Picatinny Arsenal, Dover, NJ (US)

(72) Inventors: Robert Carson, Watervliet, NY (US); David Marshall, Ballston Lake, NY (US); Tyler Bellamy, Cropseyville, NY (US); Stephen Robertson, Cambridge, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/933,665

(22) Filed: Mar. 23, 2018

(51) Int. Cl.
*F41A 21/36* (2006.01)
*F41A 21/32* (2006.01)

(52) U.S. Cl.
CPC ..... *F41A 21/36* (2013.01); *F41A 21/325* (2013.01)

(58) Field of Classification Search
CPC ..... F41A 21/36; F41A 21/40; F41A 21/34; F41A 21/32; F41A 21/325
See application file for complete search history.

(56) References Cited

U.S. PATENT DOCUMENTS 817,134 A * 4/1906 Smith ..... F41A 21/36 89/14.3
1,363,058 A * 12/1920 Schneider ..... F41A 21/36 89/14.3
2,143,596 A * 1/1939 Galliot ..... F41A 21/36 89/14.3
2,206,568 A * 7/1940 Hughes ..... F41A 21/36 89/14.3
2,567,826 A * 9/1951 Prache ..... F41A 21/36 89/14.3
3,492,912 A * 2/1970 Ashbrook ..... F41A 21/36 181/223
4,307,652 A * 12/1981 Witt ..... F41A 21/36 89/14.3
4,436,017 A 3/1984 Mohlin
4,879,942 A * 11/1989 Cave ..... F41A 21/36 89/14.3
5,652,406 A 7/1997 Phan
(Continued)

FOREIGN PATENT DOCUMENTS

GB 146929 A * 11/1920 ..... F41A 21/36
WO WO-9854533 A1 * 12/1998 ..... F41A 21/36

*Primary Examiner* — Benjamin P Lee
(74) *Attorney, Agent, or Firm* — John P. DiScala

(57) ABSTRACT

Openings in a muzzle brake provide recoil inhibition and impulse noise attenuation by redirecting the propellant gases to the external environment. A turning vane aggressively turns and redirects the propellant gases in a rearward direction to counter the recoil of the weapon system. An angled baffle provides a physical barrier to redirect propellant gases rearward to provide additional force to counteract the recoil force. Attenuation slits mitigate blast overpressure by producing a fluid barrier of high velocity propellant gases directed radially away from the muzzle brake. The fluid barrier from the attenuation slits interacts with the redirected propellant gas from the turning vane and the angled baffle and redirects the counter recoil gases away from the crew.

4 Claims, 8 Drawing Sheets

(56) References Cited

U.S. PATENT DOCUMENTS

| | | | | |
|---|---|---|---|---|
| 6,216,578 | B1 * | 4/2001 | Ledys | F41A 21/36 89/14.3 |
| 7,581,482 | B1 | 9/2009 | Cler | |
| 7,600,461 | B1 * | 10/2009 | Cler | F41A 21/36 89/14.3 |
| 8,424,440 | B1 * | 4/2013 | Carson | F41A 21/36 89/14.3 |
| 9,228,789 | B1 * | 1/2016 | Oglesby | F41A 21/36 |
| 2005/0252365 | A1 * | 11/2005 | Balbo | F41A 21/325 89/14.3 |
| 2011/0174141 | A1 * | 7/2011 | Adolphsen | F41A 21/02 89/14.3 |
| 2013/0227871 | A1 * | 9/2013 | Stone | F41A 21/30 42/76.1 |
| 2017/0191782 | A1 * | 7/2017 | Bray | F41A 21/36 |
| 2018/0087862 | A1 * | 3/2018 | McMillan | F41A 21/28 |

* cited by examiner

| Point | X coordinate | Y coordinate |
|---|---|---|
| 310 | 0.000 | 0.000 |
| 312 | 7.605 | 3.394 |
| 314 | 4.592 | 5.126 |
| 320 | 10.353 | 0.703 |
| 322 | 12.592 | 5.127 |
| 324 | 8.221 | 8.385 |

FIG. 7

CANNON RECOIL INHIBITOR AND IMPULSE NOISE ATTENUATOR

STATEMENT OF GOVERNMENT INTEREST

The inventions described herein may be manufactured, used and licensed by or for the United States Government.

BACKGROUND OF THE INVENTION

The invention relates in general to armaments and more particularly to muzzle brakes for gun tubes.

Large caliber weapons produce significant recoil energy during a firing event. Muzzle brakes are employed on these weapons to reduce the recoil energy, thereby allowing the overall weapon system to be reduced in weight. This weight reduction of the system may increase the system transportability by air and land.

Muzzle brakes operate to reduce recoil energy by redirecting propellant gases rearward to reduce the recoil energy of the cannon. The redirected propellant gases serve to balance some of the recoiling energy of the cannon during a firing event.

However, the incidence of this propellant gas upon the crew may have a direct negative effect on the crew. This negative effect of this redirected gas is call blast overpressure (BOP). High BOP levels may have severe adverse effect on the crew including significant hearing damage and damage to other body organs. Accordingly, many military organizations limit the amount and intensity of BOP exposure. For example, the U.S. Department of Defense uses the MIL-STD-1474E standard to determine the level of BOP that poses a danger and the permissible exposure levels of BOP per day.

Past solutions to mitigate BOP effects in muzzle brakes involved reducing the efficiency of the muzzle brake. The design trade-off between efficiency and BOP is not acceptable in situations involving a relatively lightweight system shooting highly energetic ballistics with exposed operators.

Accordingly, a need exists for a high efficiency muzzle brake which reduces recoil forces on the cannon during a firing event while simultaneously ensuring crew safety by alleviating the adverse effects of blast overpressure on the crew. In particular, a need exists for a high efficiency muzzle brake with low BOP effects in a large caliber weapon system, such as a 155 mm artillery weapon.

In addition to the problems posed by BOP, current muzzle brake designs also have downside as they are not suitable for modern weapon systems. Advances in weapon range and propellants necessitate the need for a more efficient solution to redirect high speed gas flow. In addition, a vane structure which is easily defined for manufacture is required. A need therefore exists for a muzzle brake with a vane assembly which aggressively redirects high speed gas flow in an efficient manner and which comprises vanes having an easily reproducible profile.

SUMMARY OF INVENTION

A first aspect of the invention is a muzzle brake for providing blast attenuation and recoil reduction. The muzzle brake includes a body defining a supersonic flow passage and further includes a blast overpressure attenuation flow stage and a gas redirection flow stage. The blast overpressure attenuation flow stage redirects propellant gases to an exterior of the muzzle brake to create a fluid barrier which interferes with propellant gases redirected to the exterior muzzle brake by the gas redirection flow stage to mitigate blast overpressure.

A second aspect of the invention is a muzzle brake for providing blast attenuation and recoil reduction for an artillery cannon. The muzzle brake includes a body defining a supersonic flow passage. The supersonic flow passage is comprised of a blast overpressure attenuation flow stage, a gas redirection flow stage and an angled baffle flow stage. The blast overpressure attenuation stage redirects propellant gas from the interior of the muzzle brake to the exterior of the muzzle brake substantially normal to the muzzle brake. The blast overpressure attenuation stage further comprises a first slit or holes and a second slit or holes defined by the body and extending from an interior surface of the body to an exterior surface of the body at an attenuation angle with respect to a central longitudinal axis of the muzzle brake and shot direction. The gas redirection flow stage is axially forward of the blast overpressure attenuation stage. The gas redirection flow stage further comprises a first turning vane and a second turning vane defined by the body and extending from an interior surface of the body to an exterior surface of the body which redirects propellant gas from the interior of the muzzle brake to the exterior of the muzzle brake in a direction opposing a recoil force on the cannon. The angled baffle stage is axially forward of the gas redirection flow stage and comprising an angled baffle defined by the body and extending from an interior surface of the body to an exterior surface of the body. The angled baffle redirects propellant gas from the interior of the muzzle brake to the exterior of the muzzle brake in a direction opposing a recoil force on the cannon. The propellant gas redirected by the blast overpressure attenuation stage interferes with the propellant gas redirected by the gas redirection flow stage and the angled baffle stage thereby minimizing blast overpressure.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 7 is a table of coordinates that define the profiles of the turning vane assembly, in accordance with one illustrative embodiment of the invention.

DETAILED DESCRIPTION

A muzzle brake for a weapon system utilizes three flow stages to provide high efficiency recoil reduction while simultaneously ensuring crew safety by alleviating the adverse effects of blast overpressure (BOP) on the crew. The combination of efficiency and BOP reduction allows the weapon system to achieve high levels of performance without making significant concessions to system weight or operator safety. In addition, by reducing BOP effects, the operating crew of the weapon may fire more rounds per day and still fall under safe thresholds thereby increasing the lethality of the weapon system.

Figure 1:
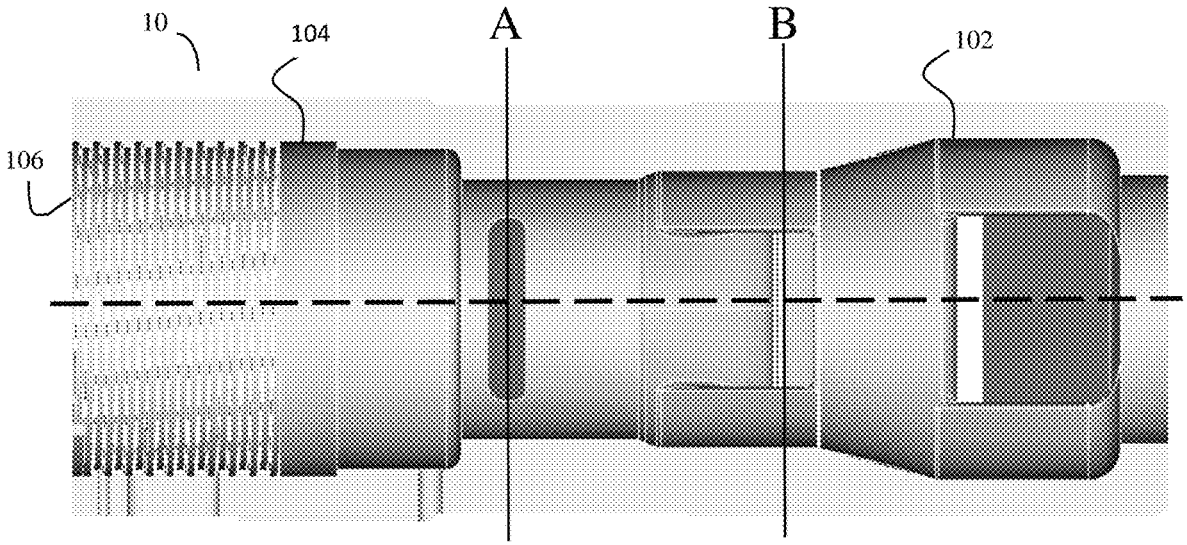
FIG. 1 is a side plan view of a muzzle brake, in accordance with one illustrative embodiment.

FIG. 1 is a side plan view of a muzzle brake, in accordance with one illustrative embodiment. The muzzle brake 10 comprises three flow zones which redirect propellant gases to mitigate recoil forces on a large caliber weapon system by redirecting propellant gases rearward while minimizing BOP effects.

The muzzle brake 10 is suitable for use on a large caliber weapon system and more particularly on a large caliber artillery system. In one embodiment, the muzzle brake 10 is configured for operating on a M777 155 millimeter (mm) artillery system employed by the armed forces of the United States. While throughout this specification, the muzzle brake 10 will be described in the context of operating in conjunction with an artillery weapon and more particularly in the context of a 155 millimeter artillery weapon, the muzzle brake 10 is not limited to a 155 mm artillery weapon. The muzzle brake 10 may be employed on an artillery weapon of a different caliber, such as a 105 mm weapon or a 120 mm weapon. In addition, the muzzle brake 10 may be employed on other types of weapon systems such as tank cannons, mortar systems, light weapons and small arms or any other weapon system which fires armaments which produce both recoil forces and BOP.

The muzzle brake 10 comprises a body 102 having a rear portion 104 for attachment to a muzzle end of a gun tube of a weapon system. The rear portion 104 may have internal threads 106 which engage with external threads of the gun tube to threadably attach the muzzle brake 10 to the gun tube. Subsequent to a firing event, a fired round exits the gun barrel and travels through a central passage in the muzzle brake 10 propelled by a supersonic flow of hot propellant gases. The fired round exits the muzzle brake 10 through a front end of the muzzle brake 10.

Openings in the muzzle brake 10 provide recoil inhibition and impulse noise attenuation by redirecting the propellant gases to the external environment. One or more turning vanes aggressively turn and redirect the propellant gases in a rearward direction to counter the recoil of the weapon system. One or more angled baffles provide additional force to counteract the recoil force by presenting a physical barrier which redirect propellant gases rearward. Attenuation openings mitigate BOP by venting one or more fluid barriers of propellant gas radially away from the muzzle brake 10. The combined interaction of the redirected flow from each flow stage produces a flow pattern on the exterior of the muzzle brake 10 which directs high pressure away from the crew of the cannon.

Figure 2:
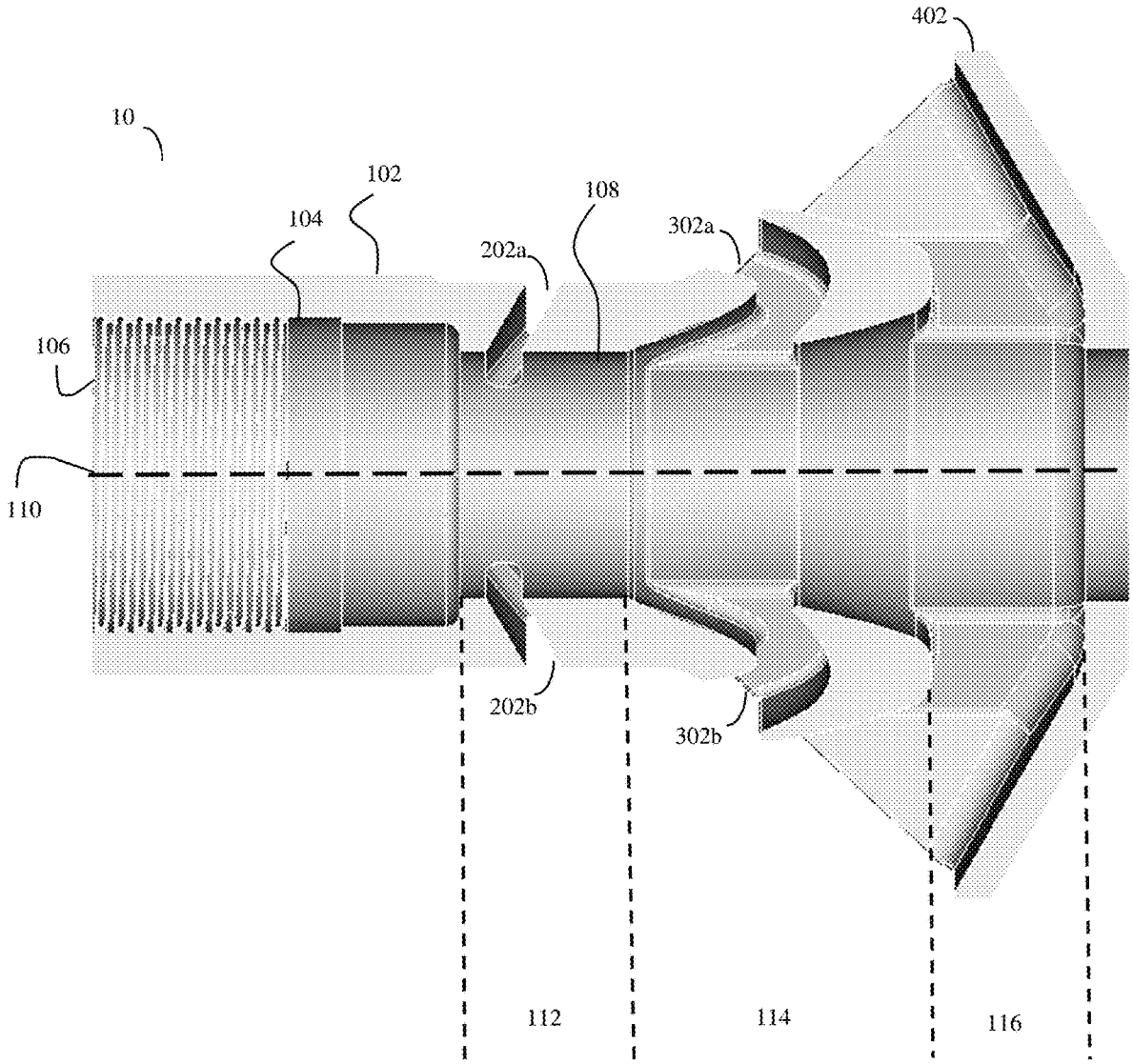
FIG. 2 is a sectional top view of muzzle brake, in accordance with one illustrative embodiment.

FIG. 2 is a sectional top view of muzzle brake, in accordance with one illustrative embodiment. The rear portion 104 of the body 102 of the muzzle brake 10 defines a longitudinal bore sized and dimensioned to receive the muzzle end of the weapon. Internal threads 106 line a portion of the internal surface of the rear portion 104 proximate the weapon. Further aft of the internal threads, the bore interior profile matches the cannon exterior profile. At the distal end of the rear portion 104, the bore of the rear portion 104 decreases in diameter.

The remaining body 102 of the muzzle brake 10 defines a longitudinal bore serving as a supersonic flow passage 108. The longitudinal bore extends from the rear portion 104 of the body 102 to the front portion of the body 102 centered along a central longitudinal axis 110 of the body 102. Supersonic flow enters the central flow passage 108 at the rear portion 104 of the muzzle brake 10 from the gun tube and exits from an opening at the distal end of the muzzle brake.

The muzzle brake 10 further comprises three flow stages, 112, 114, 116 extending axially along the body 102. Each of the three flow stages comprises features which direct propellant gases from the flow passage 108 to the exterior of the muzzle brake 10. The combined interaction of the redirected flow from each flow stage produces a flow pattern on the exterior of the muzzle brake 10 which is directed away from the crew of the cannon.

A first flow stage 112, a blast overpressure attenuation flow stage 112, comprises one or more attenuation openings for redirecting propellant gases at an angle away from the muzzle brake 10. The first flow stage 112 extends from the distal end of the rear portion 104 of the body 102 to a turning vane of the second flow stage 114. A second flow stage 114, a gas redirection flow stage 114, comprises a turning vane for aggressively turning propellant gases rearward. The second flow stage 114 is axially forward of the blast overpressure attenuation flow stage 112 and extends across the axial length of the turning vane. A third flow stage 116, an angled baffle flow stage 116, comprises an angled baffle for redirecting additional propellant gases rearward. The third flow stage 116 is axially forward of the gas redirection flow stage.

The blast overpressure attenuation flow stage 112 comprises one or more attenuation openings 202 defined by the body 102 and extending from an interior surface of the muzzle brake 10 to an exterior surface. The attenuation openings 202 are openings in the body 102 which provide an outlet for propellant gases from the central supersonic flow passage 108 to the external environment of the muzzle brake. Each of the attenuation openings 202 extend from an inner surface of the body 102 to an outer surface of the body 102. The openings allow propellant gas to escape such that a quantity of propellant gas exits the exterior of the muzzle brake 10 at a high velocity in a substantially radial direction (i.e. approximately orthogonal to the longitudinal axis 110) away from the muzzle brake 10. The radially directed propellant gas from each attenuation opening presents a barrier to the rearward travel of propellant gases from subsequent stages which are redirected rearward to mitigate recoil.

The number, size and dimension of the attenuation openings are dictated by the application of the muzzle brake 10 and may be optimized for various weapon systems, caliber sizes and operating conditions. In the embodiment shown in FIGS. 1-4 and described throughout this specification, the attenuation openings comprise two attenuation slits 202. However, the muzzle brake 10 is not limited to two attenuation slits 202 and in other embodiments, the muzzle brake 10 may have more than two attenuation slits 202 or less than two attenuation slits 202. Further, the attenuation openings are not limited to slits 202 having the dimensions shown or even limited to slit shaped openings. The attenuation openings may be any sized and dimensioned opening in the muzzle brake 10 which allows propellant gas to escape from the interior of the muzzle brake 10 to the exterior of the muzzle brake 10 such that the propellant gas is directed away from the muzzle brake 10 in a generally radial direction at a high velocity. For example, in one embodiment, the attenuation openings comprises a plurality of holes sized and dimensioned such that propellant gas escapes and exits at a substantially radial direction.

In the embodiment shown in FIG. 2, the muzzle brake 10 comprises two attenuation slits 202. A right attenuation slit 202*a* is positioned on a right side of the muzzle brake 10 with its center aligned with a central axis 110 of the muzzle brake 10. A left attenuation slit 202*b* is positioned on a left side of the muzzle brake 10, diametrically opposed from the right attenuation slit 202*a* and with its center aligned with a central axis 110 of the muzzle brake 10.

Figure 3:
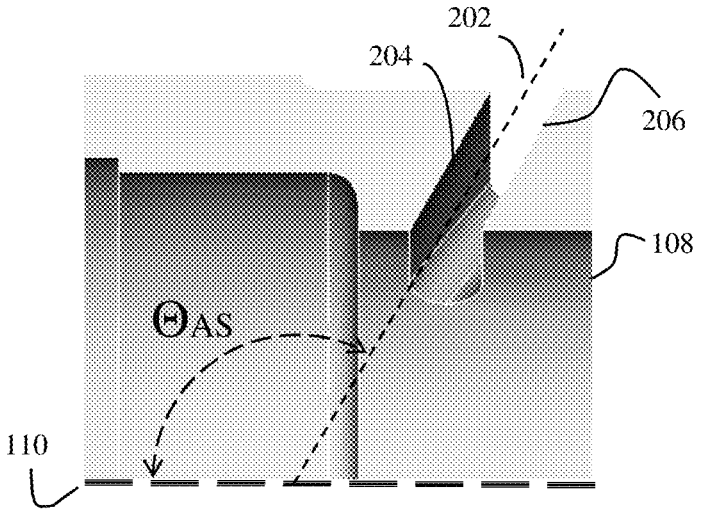
FIG. 3 is a sectional top view of an attenuation slit of a muzzle brake, in accordance with one illustrative embodiment.

FIG. 3 is a sectional top view of an attenuation slit of a muzzle brake, in accordance with one illustrative embodiment. As supersonic flow enters the muzzle brake 10 from the cannon, a portion of the flow enters the attenuation slits 202. For each attenuation slit 202, a shock is formed across the attenuation slit 202 between a suction side 204 and a pressure side 206 of the attenuation slit. The shock decelerates the flow within the 202 slit due to separation of the flow. The pressure side of the attenuation slit 202 redirects the decelerated flow in the direction of the attenuation slit. The escaping propellant gas is reaccelerated as it exits the muzzle brake 10. The geometry of the attenuation slit 202 in combination with the flow characteristics of the escaping propellant gas causes the propellant gas to project in a radial direction away from the muzzle brake 10. The radially projecting propellant gas forms a fluid barrier of high velocity fluid on the sides of the muzzle brake 10 which serves to redirect any subsequent rearward directed gas around the cannon crew.

The escaping propellant gas must exit the muzzle brake 10 at a substantially radial direction so as not to contribute to the recoil forces or the blast overpressure. To achieve this, the attenuation slits 202 are angled axially forward in a direction from the rear portion 104 of the body 102 toward the front portion of the body 102 such that the propellant gas exits at a high velocity in a radial direction. The forward angle $\Theta_{AS}$ of the attenuation slit 202 is the angle formed between the central longitudinal axis 110 of the body 102 and the longitudinal axis 110 of the attenuation slit. In the embodiment shown in FIG. 3, the forward angle is an obtuse angle. While the forward angle is obtuse; due to the flow characteristics within the attenuation slit, the resulting flow away from the muzzle brake 10 is in a radial direction.

For the fluid barrier to be effective, it must be in close enough proximity to the output of the gas redirection flow stage. In an embodiment of the invention, the exterior opening of the blast overpressure attenuation flow stage 112 is axially rear of the gas redirection flow stage by approximately one caliber length. Locating the gas redirection flow stage one caliber length axially forward of the blast overpressure attenuation flow stage 112 ensures that the blast overpressure attenuation flow stage 112 is within sufficient distance to influence the second flow stage 114.

Figure 4:
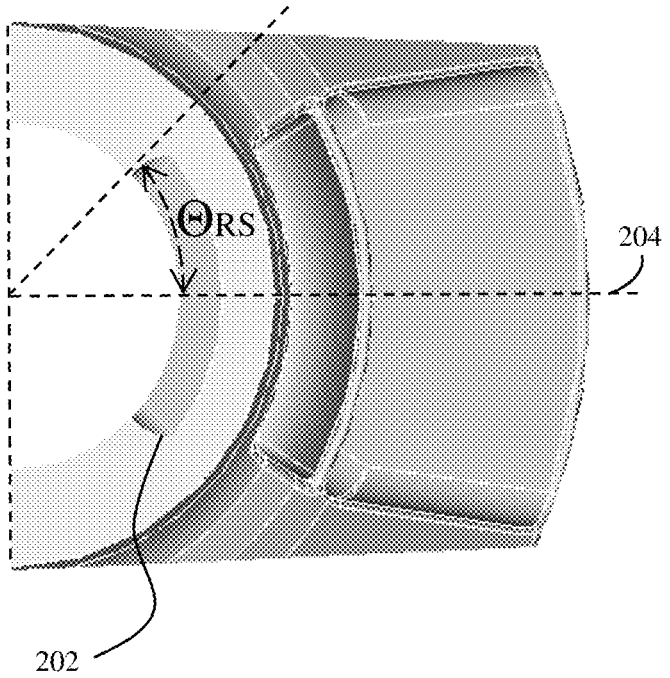
FIG. 4 is a sectional front view of the muzzle brake at an attenuation slit of the muzzle brake, in accordance with one illustrative embodiment.

FIG. 4 is a sectional front view of the muzzle brake at an attenuation slit 202 of the muzzle brake 10, in accordance with one illustrative embodiment. The sectional view of FIG. 4 is taken along a plane orthogonal to the central longitudinal axis 110 which bisects the attenuation slits 202. This plane is represented as line A in FIG. 1. The fluid barrier formed by the output of the attenuation slits 202 must have a cross-section greater than or equal to cross-section of the output of the gas redirection flow stage 114 to effectively mitigate blast overpressure effects of that section. Each attenuation slit 202 extends circumferentially around the muzzle brake 10 at a radial angle $\Theta_{RS}$ with respect to a central radial axis 204. The radial angle $\Theta_{RS}$ is chosen to produce a fluid barrier with the cross section required by the output of the turning vane.

Figure 5:
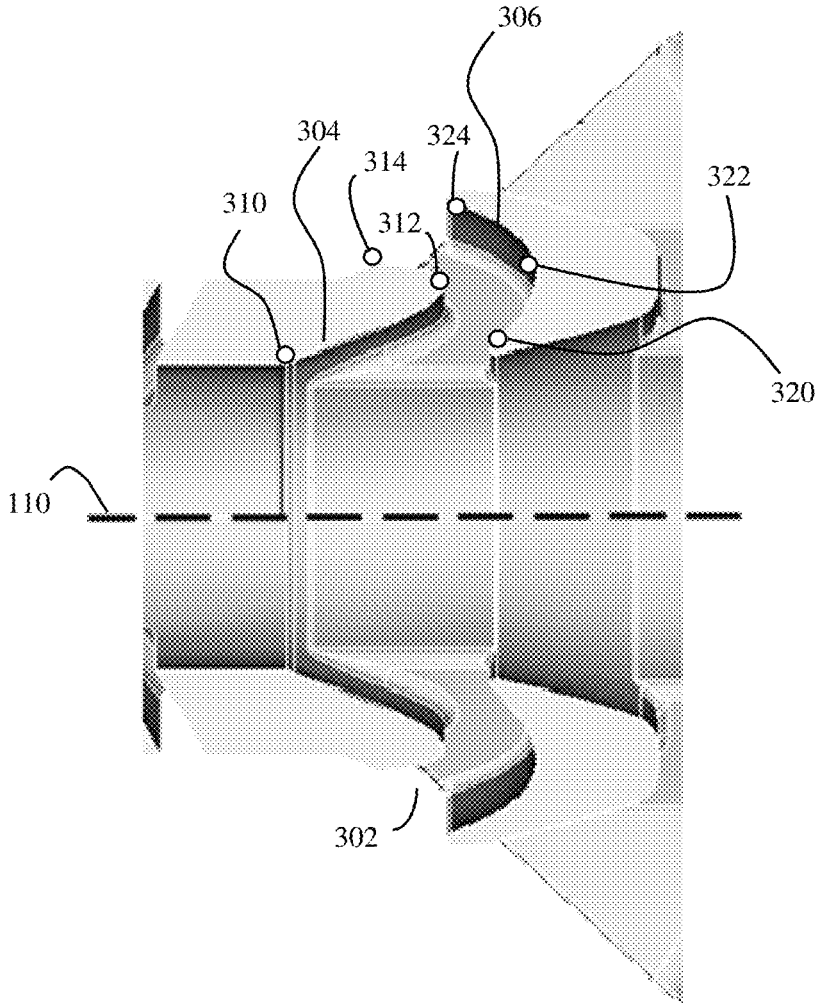
FIG. 5 is a sectional top view of a turning vane, in accordance with one illustrative embodiment.

FIG. 5 is a sectional top view of a turning vane, in accordance with one illustrative embodiment. The gas redirection flow stage 114 comprises one or more turning vanes 302 for aggressively redirecting propellant gases 180 degrees rearward of the muzzle brake 10 to counter the recoil forces of the firing event. The turning vanes 302 are openings in the body 102 which provide a flow passage for propellant gases from the central supersonic flow passage 108 slowed, redirected and accelerated to the external environment. The profiles defining each of the turning vanes are parabolas which may be modelled as a quadratic Bezier curve thereby allowing for the vane to be more easily replicated and manufactured.

In the embodiment shown in FIG. 5, the muzzle brake comprises two turning vanes 302. A right turning vane 302*a* is positioned on a right side of the muzzle brake 10 and axially aligned with the right attenuation slit 202*a*. A left turning vane 302*b* is positioned on the left side of the muzzle brake 10, diametrically opposed to the right turning vane 302*a*, and axially aligned with the left attenuation slit 202*b*. However, the muzzle brake 10 is not limited to two turning vanes 302 and in other embodiments, the muzzle brake 10 may have more than two turning vanes 302 or less than two turning vanes 302. In other embodiments, the muzzle brake 10 may comprise additional stages of turning vanes 302, the additional vanes having the same or different profiles as the turning vane 302.

Figure 6:
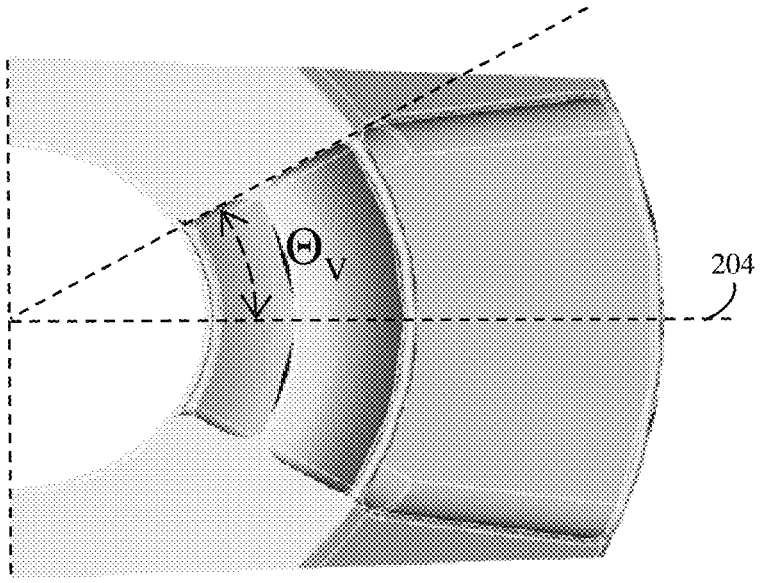
FIG. 6 is a sectional front view of a muzzle brake at a turning vane of the muzzle brake, in accordance with one illustrative embodiment.

FIG. 6 is a sectional front view of a muzzle brake at a turning vane of the muzzle brake, in accordance with one illustrative embodiment. The sectional view is taken along a plane orthogonal to the central longitudinal axis 110 and which bisects the turning vane 302. This plane is represented as line B in FIG. 1. The radial angle $\Theta_V$ of the turning vane 302 is selected according to the recoil mitigation requirements of the system. Generally, a larger radial angle $\Theta_V$ may provide more recoil mitigation force as it allows for a larger volume of propellant gas to be directed out of the turning vane 302. However, in certain embodiments, the radial angle $\Theta_V$ may be limited by operational concerns. For example, in embodiments in which the muzzle brake 10 is implemented on an artillery cannon, the radial angle is limited as propellant gases may only be vented to the sides due to obscuration issues. Accordingly, the turning vane radial angle $\Theta_V$ is limited such that the turning vane only extends around the sides of the cannon.

The turning vane 302 includes a suction side 304 and a pressure side 306. The suction side 304 includes an expansion turning wall comprising an angled portion near point 310 and a parabolic curved portion. The expansion turning wall creates an expansion fan that projects into the supersonic flow passage 108 to turn supersonic flow into the turning vane 302. The pressure side 306 comprises a large radius of curvature relative to the chord length or passage hydraulic chamber.

The pressure side 306 and the suction side 304 converge to form a throat. The throat is the area of minimum cross-section in the turning vane 302. A shock is formed in the throat. The shock decelerates the supersonic flow to subsonic speed. The pressure side 306 turns the subsonic flow. The suction side 304 includes an outer nozzle expansion wall downstream of the throat. The outer nozzle expansion wall diverges from the pressure side 306 to form an expansion nozzle that expands the subsonic flow to supersonic speed.

At angled portion, the wall makes a relatively sharp turn and continues as a parabolic curved section. The angled portion and the parabolic curved section form the expansion turning wall on the suction side 304 of the turning vane 302. The expansion turning wall creates the expansion fan. The expansion fan projects into the center core flow of the flow passage 108. The expansion fan efficiently turns a portion of the supersonic flow into the vanes.

Slightly down the suction side 304, a shock is formed due to separation along the suction side. The location of the shock is influenced by the angle of expansion wall, the change in radius and the width of the throat. The shock decelerates the supersonic flow, which has been diverted by the expansion fan to subsonic speeds. The subsonic flow is then turned by the pressure side 306 of the turning vane 302. The majority of the turning of the flow of the turning vane 302 occurs at the pressure side 306. Because the flow is subsonic at the pressure side 306, the turning is very efficient causing a high pressure on the wall surface. The throat controls flow through the turning vane 302.

After the flow is turned, it is expanded in the expansion nozzle to supersonic speed. The pressure side 306 and the outer nozzle expansion wall define the expansion nozzle. In the expansion nozzle, the pressure is reduced and additional thrust is produced.

FIG. 7 is a table of coordinates that define the profiles of the turning vane assembly, in accordance with one illustrative embodiment of the invention. Each of the profiles of the turning vane 302 (suction side 304, pressure side 306) are parabolas defined by four points, the two end points, a vertex and a focus point. The parabolas may be modelled as Bezier curves and expressed as quadratic parametric equations. Accordingly, the vane profiles are easily replicated and manufacturable in comparison to prior art solutions.

A rectangular coordinate system has its origin 0,0 at point 310, near where the suction side intersects the flow passage 108. The profiles of the suction side 304, pressure side 306 can each be described by four points having x,y coordinates relative to the origin. Each of the profiles is a Bezier curve defined by three points. The x,y coordinates of each of these points are dimensionless.

The suction side is defined by the end points 310 and 314, and the shoulder point 312. The pressure side is defined by the end points 320 and 324, and the shoulder point 322.

The x,y coordinates for each of these points is given in FIG. 7. The turning vane 302 has a shape such that the coordinates of its points correspond substantially to the coordinates in FIG. 7. Variations from the coordinates shown in FIG. 7 are allowable as long as the turning vane functions as described above.

Given the identifying points described above, each of the profiles may be expressed in the form of a parametric quadratic equation defining the Bezier curve of each profile.

The suction side 304 can be expressed in the form of two parametric equations as $$x_1(t)=25.828t-21.236t^2;$$

$$y_1(t)=8.450t-3.324t^2$$

$$(0\leq t\leq 1)$$

The pressure side 306 can be expressed in the form of two parametric equations as:

$$x_2(t)=10.353+11.088t-13.220t^2;$$

$$y_2(t)=0.703+10.014t-2.332t^2$$

$$(0\leq t\leq 1)$$

The turning vane 302 has a shape such that the coordinates of its points correspond substantially to the equations given above. Variations from the equations above are allowable as long as the vane functions as described above.

Figure 8:
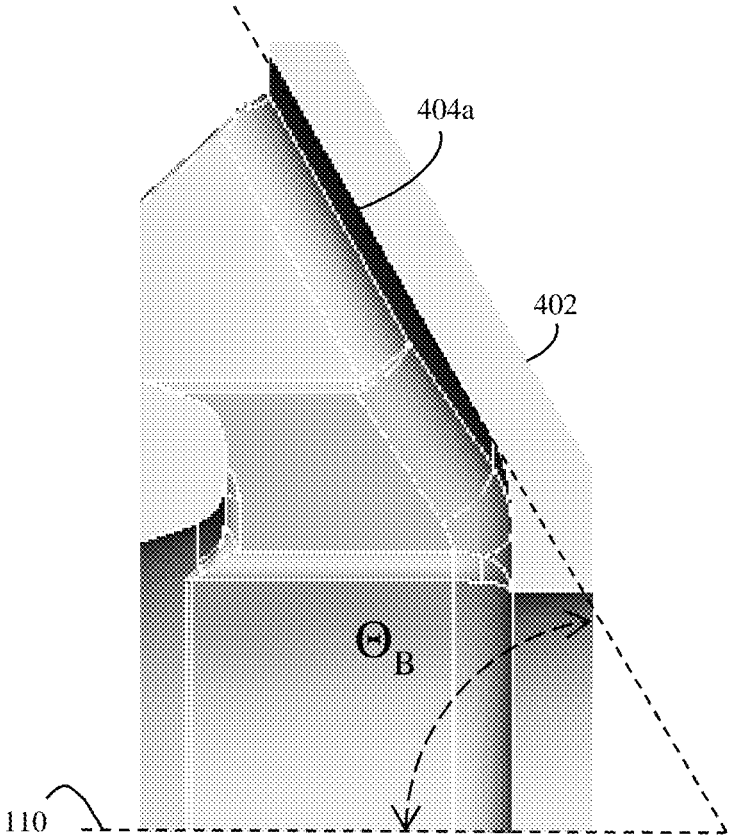
FIG. 8 is a sectional top view of an angled baffle, in accordance with one illustrative embodiment.

FIG. 8 is a sectional top view of an angled baffle, in accordance with one illustrative embodiment. The angled baffle flow stage 116 comprises an angled baffle 402 for providing additional counter-recoil force by redirecting propellant gas rearward. In embodiments in which the gas redirection flow stage 114 does not provide all the required counter recoil forces, an angled baffle flow stage 116 may be utilized to provide additional counter recoil forces. For example, in artillery systems, the radial angle of the turning vanes 302 may be limited due to operational concerns regarding venting below the cannon. Accordingly, the counter recoil force provided solely by the turning vanes 302 may be insufficient thereby necessitating an angled baffle flow stage 116.

The angled baffle 402 is defined by the body 102 of the muzzle brake 10 and comprises one or more angled walls 404. The angled wall physically impedes the flow of propellant gases and redirecting out of the muzzle brake 10 and rearward. In the embodiment shown in FIG. 8, the angled baffle comprises two angled walls, a right angled wall 404*a* on a right side of the body 102 and a left angled wall 404*b* on a left side of the body 102. The angled walls 404 are diametrically opposed and axially aligned with corresponding attenuation slits 202 and turning vanes 302.

The angled walls 404 provide a physical impediment to flow turned into the baffle. Each angled wall 404 forms a baffle angle $\Theta_B$ with respect to the central longitudinal axis 110 of the muzzle brake 10. Baffle angles $\Theta_B$ which are more acute are relatively more aggressive than larger angles. Aggressive baffle angles redirect propellant gas rearward and therefore contribute to blast overpressure effects unless mitigated.

Initially, the propellant gas redirected by the turning vanes 302 and the angled baffle 402 is redirected in a rearward direction thereby countering the recoil energy of the weapon system. As the propellant gas travels backward toward the rear portion 104 of the muzzle brake 10, the propellant gas interacts with the fluid barrier created by the attenuation slits 202. This orthogonal fluid barrier of propellant gas redirects the rearward redirected propellant gas away from the muzzle brake 10 and ultimately around the cannon crew thereby mitigating the blast overpressure which reaches the crew.

While the invention has been described with reference to certain embodiments, numerous changes, alterations and modifications to the described embodiments are possible without departing from the spirit and scope of the invention as defined in the appended claims, and equivalents thereof.

What is claimed is:

1. A muzzle brake for providing blast attenuation and recoil reduction on an artillery cannon, the muzzle brake comprising:

a body defining a supersonic flow passage;

a blast overpressure attenuation flow stage for redirecting propellant gas from the interior of the muzzle brake to the exterior of the muzzle brake substantially normal to the muzzle brake to produce a fluid barrier and further comprising a first attenuation slit and a second attenuation slit defined by the body and extending from an interior surface of the body to an exterior surface of the body and wherein the first attenuation slit and the second attenuation slit are diametrically opposed to each other and confined to a right side of the muzzle brake and a left side of the muzzle brake and wherein the fluid barrier normal to the muzzle brake is produced through deceleration and turning of the propellant gas via formation of a shock within the first attenuation slit and the second attenuation slit;

a gas redirection flow stage axially forward of the blast overpressure attenuation stage and further comprising a first turning vane and a second turning vane defined by the body and extending from an interior surface of the body to an exterior surface of the body, the first turning vane and the second turning vane being diametrically opposed to each other and axially aligned with the first attenuation slit and the second attenuation slit and confined to a right side of the muzzle break and a left side of the muzzle brake, wherein each of the first turning vane and second vane redirects propellant gas from the interior of the muzzle brake to the exterior of the muzzle brake in a direction opposing a recoil force on the cannon through deceleration, turning and reacceleration of the propellant gas via formation of a shock within the first turning vane and the second turning vane; and an angled baffle stage axially forward of the gas redirection flow stage and comprising an angled baffle defined by the body and extending from an interior surface of the body to an exterior surface of the body which redirects propellant gas from the interior of the muzzle brake to the exterior of the muzzle brake in a direction opposing a recoil force on the cannon by presenting a physical impediment to the propellant gas; and wherein the fluid barrier interferes with the propellant gas redirected by the gas redirection flow stage and the angled baffle stage thereby minimizing blast overpressure.

2. The muzzle brake of claim 1 wherein the first attenuation slit and the second attenuation slit extend from the interior surface to the exterior surface at an obtuse angle with respect to a central longitudinal axis of the muzzle brake such that propellant gas from the interior of the muzzle brake is redirected to the exterior of the muzzle brake substantially normal to the muzzle brake to produce a fluid barrier.

3. The muzzle brake of claim 1 wherein the first attenuation slit and second attenuation slit each extend along the circumference of the muzzle brake body at a radial angle at least equal to a radial angle of the first turning vane and the second turning vane.

4. The muzzle brake of claim 1 wherein an output of the gas redirection flow stage is approximately one caliber axially forward of an output of the blast overpressure attenuation flow stage.

* * * * *